US006471394B2

(12) United States Patent
Kesig

(10) Patent No.: US 6,471,394 B2
(45) Date of Patent: Oct. 29, 2002

(54) MIXER APPARATUS AND METHOD WITH IMPROVED SHAFT STUB END SEAL STRUCTURE

(75) Inventor: Ricky D. Kesig, Cincinnati, OH (US)

(73) Assignee: Littleford Day, Incorporated, Florence, KY (US)

( * ) Notice: Subject to any disclaimer, the term of this patent is extended or adjusted under 35 U.S.C. 154(b) by 70 days.

(21) Appl. No.: 09/800,824

(22) Filed: Mar. 7, 2001

(65) Prior Publication Data

US 2002/0126571 A1 Sep. 12, 2002

(51) Int. Cl.[7] ..... B01F 15/00

(52) U.S. Cl. ..... 366/331

(58) Field of Search ..... 366/331, 608; 277/391, 394

(56) References Cited

U.S. PATENT DOCUMENTS

| | | | |
|---|---|---|---|
| 101,810 | A | 4/1870 | Atkinson |
| 565,817 | A | 8/1896 | Walker, Jr. |
| 660,532 | A | 10/1900 | McRae |
| 724,086 | A | 3/1903 | Davis |
| 1,102,696 | A | 7/1914 | Shiner |
| 1,562,019 | A | 11/1925 | Wilkinson |
| 1,700,321 | A | 1/1929 | Lauterbur |
| 1,705,057 | A | 3/1929 | Brandus |
| 1,746,068 | A | 2/1930 | Barnes |
| 2,008,543 | A | 7/1935 | Dickinson |
| 2,082,796 | A | 6/1937 | Gaertner |
| 2,125,446 | A | 8/1938 | Hurtt |
| 2,340,022 | A | 1/1944 | Shellenberger |
| 2,621,087 | A | 12/1952 | Kluge |
| 2,635,931 | A | 4/1953 | May |
| 2,688,520 | A | 9/1954 | Covington |
| 2,723,110 | A | 11/1955 | Collins |
| 2,853,020 | A | 9/1958 | Hollinger et al. |
| 2,867,997 | A | 1/1959 | Lake |
| 2,906,565 | A | 9/1959 | Scherba |
| 2,946,608 | A | 7/1960 | Gilbert, Sr. |
| 2,948,554 | A | 9/1960 | Mahand |

(List continued on next page.)

FOREIGN PATENT DOCUMENTS

| | | |
|---|---|---|
| AT | 212294 | 1/1959 |

OTHER PUBLICATIONS

Littleford Sales Brochure, *Littleford Drying Technology,* Bulletin No. LM–630 5/94, 12 pages Littleford Sales Brochure, *Littleford Mixer/Granulator,* Bulletin No. 212, 3/85, 4 pages Littleford Sales Brochure, *Littleford Mixers and Mixing Systems for Food/Candy Processing,* Bulletin No. LM–224, 1992, 8 pages

*Primary Examiner*—Tony G. Soohoo

(74) *Attorney, Agent, or Firm*—Wood, Herron & Evans, LLP

(57) ABSTRACT

A mixer for mixing and processing materials comprises a mixing chamber with an inner space configured for receiving material to be mixed. An elongated rotatable mixing shaft extends through the chamber inner space and has a stub end and a drive end positioned proximate opposing ends of the mixing chamber. A non-rotatable stub shaft extends through an opening in the end of the mixing chamber and is coupled to the chamber end for linear translation therethrough. The stub shaft is generally prevented from rotating in the chamber end. The stub end of the mixing shaft is rotatably coupled to the stub shaft within the inner space for rotating in the mixing chamber without extending through the end of the chamber. A static seal structure is coupled between the stub shaft and the end of the mixing chamber for sealing the chamber inner space from the environment outside of the mixing chamber. The seal structure is operable for moving with the linear translation of the stub shaft for maintaining the seal during translation.

17 Claims, 2 Drawing Sheets

U.S. PATENT DOCUMENTS 2,971,800 A 2/1961 Ruthner
3,068,051 A 12/1962 Koch
3,120,948 A 2/1964 Stratienko
3,128,133 A 4/1964 Audemar
3,318,606 A 5/1967 Houck
3,415,581 A 12/1968 Seubert
3,443,794 A 5/1969 Peterson
3,559,957 A 2/1971 Hurter
3,561,826 A 2/1971 Cary et al.
3,666,276 A 5/1972 Hubler ..... 277/30
3,674,326 A 7/1972 Kaiser
3,679,277 A 7/1972 Dohmen ..... 308/187.1
3,722,834 A 3/1973 Bakewell
3,749,464 A 7/1973 Satterthwaite ..... 308/36.1
3,887,169 A 6/1975 Maynard
3,949,972 A 4/1976 Bell et al.
4,146,333 A 3/1979 Zani ..... 366/99
4,189,242 A 2/1980 Luke ..... 366/288
4,192,559 A 3/1980 Hewitt ..... 308/36.1
4,304,446 A 12/1981 Goodine ..... 308/187.1
4,348,067 A 9/1982 Tooley ..... 308/187
4,381,127 A 4/1983 Visser ..... 384/151
4,412,747 A 11/1983 Moriyama ..... 366/99
4,437,767 A 3/1984 Hargis ..... 366/287
4,506,983 A 3/1985 Marr
4,509,860 A 4/1985 Lasar, III ..... 366/99
4,575,253 A 3/1986 List et al. ..... 366/331
4,630,458 A 12/1986 Kakabaker ..... 72/237
4,705,222 A 11/1987 Shohet ..... 241/69
4,728,198 A 3/1988 Maekawa et al. ..... 366/279
4,850,723 A 7/1989 Whiteman, Jr. ..... 384/477
4,878,677 A 11/1989 Larkins et al. ..... 277/105
4,898,714 A 2/1990 Urban et al. ..... 422/133
5,056,800 A 10/1991 Becker ..... 277/68
5,094,540 A 3/1992 Face, Jr. ..... 366/46
5,275,484 A 1/1994 Shohet ..... 366/132
5,277,489 A 1/1994 Hamm ..... 366/331
5,468,071 A 11/1995 Tourneux et al. ..... 384/276
5,735,603 A 4/1998 Kesig ..... 366/331

MIXER APPARATUS AND METHOD WITH IMPROVED SHAFT STUB END SEAL STRUCTURE

FIELD OF THE INVENTION

This invention relates generally to apparatus and method for industrial mixing and processing and particularly to horizontally arranged industrial mixers having horizontally disposed mixing shafts extending through the mixing chamber.

BACKGROUND OF THE INVENTION

Processing of a large variety of consumer and industrial products, such as food, plastic, pharmaceutical and chemical products, for example, usually involves one or more mixing steps for mixing the various component materials of the products. Such mixing steps are oftentimes accompanied by the simultaneous introduction or removal of heat, such as for drying the material being mixed or cooling heated products while they are mixed. Product mixing is also often accompanied by granulation or chopping of the material forming the product. Often, for numerous products, the materials are mixed in a dry, powdered or granular form, and the mixing process is referred to generally as solids mixing.

For accomplishing such solids mixing, large-capacity industrial mixers are utilized, which are able to handle very large loads of material for efficient and cost-effective mixing. One type of mixer design, which is suitable for solids mixing and is able to effectively mix large loads of material, is a horizontal mixer. Horizontal mixers have an elongated mixing chamber which is disposed generally horizontally with respect to the ground surface on which the mixer rests. More specifically, horizontal mixers generally comprise an elongated cylindrical mixing chamber, and an elongated, horizontal mixing shaft which extends through the chamber and rotates. A plurality of mixing tools depend generally perpendicularly from the horizontal shaft and rotate around the inside of the chamber when the shaft is rotated. The mixing tools are configured and dimensioned as required for the mixing process to follow the cylindrical inside walls of the chamber for proper mixing of all of the material in the chamber.

In a conventional horizontal mixer, the elongated horizontal mixing shaft extends out of the mixing chamber at both ends of the chamber through appropriate openings in the chamber end walls or head walls. At one end of the shaft, referred to as the drive end, the shaft is operably coupled to a drive motor and gearing which rotates the shaft. At the drive end, the shaft is coupled through a bearing structure located between the drive motor and the chamber. The bearing structure provides support of the shaft drive end and also ensures smooth rotation. A separate seal structure is then located further in along the length of the shaft and interfaces with the opening in the end wall through which the drive end of the mixing shaft extends.

The other end of the mixing shaft, referred to as the stub end of the shaft, is not driven, but rather rotates with the drive shaft. The stub end of the mixer also includes a seal structure to seal the stub end of the shaft and the end wall opening through which it extends. The seal structures at the ends of the shaft isolate the mixing chamber environment from the outside environment and generally prevent the passage or leakage of material into and out of the mixing chamber. The seal structures used in such horizontal mixers are therefore important to ensure the integrity and purity of the material being mixed and are also necessary for preventing leaks and protecting the health of workers in the area of the mixers.

As may be appreciated, leakage between the horizontal mixing chamber and the outside environment and atmosphere during mixing is undesirable. For example, edible products such as pharmaceuticals and foods must not be contaminated with foreign materials which may leak into the mixing chamber at the shaft end openings. Grease or oil associated with the drive motor and/or the shaft bearings must also be kept out of the mixing chamber. Furthermore, it is also equally important to contain the mixed material in the chamber and to prevent it from migrating and leaking to the outside environment through the shaft end openings of the mixer. This is particularly so if the material being mixed is a harmful chemical which cannot be directly contacted by the skin or if the mixed material produces a harmful vapor which may be released through the shaft openings.

Still further, it may be necessary to maintain a pressure differential between the horizontal mixing chamber and the outside environment to achieve proper mixing. For example, some mixing procedures require elevated pressures within the chamber which may be compromised by a leak. Furthermore, under such circumstances, a leak will tend to force mixed material through openings in the mixing chamber, such as out through the shaft end seals. Other procedures require that a vacuum be drawn in the chamber which would also be compromised by a leak. Also, a leak would draw contaminants into the chamber through the shaft end openings and seals.

While the seal structures of existing horizontal mixers operate somewhat adequately for their intended purpose, they have several drawbacks. More specifically, the seal structures at the stub end of the mixing shaft can be of particular concern, due to their location in the mixer.

First, many existing seal structures, including the stub end seal structures, are expensive. Because the rotating drive and stub ends of the mixing shaft extend through the end walls of the mixer, the seal structures must be dynamic seals which can handle both rotation and translation of the shaft, while still maintaining the seal. The seal structures, for example, may include elaborate dynamic seals with braided packing elements that surround the rotating shaft or may include expensive mechanical seals. The packing elements of certain dynamic seals are constantly worn by the rotation and linear movement of the shaft and thus are prone to wear and leakage. Therefore, constant maintenance and replacement of the dynamic seals are necessary. Some such seal structures must be coupled to an air line for preventing migration or leakage of the mixed material out of the chamber or the leakage of contaminants into the chamber. Mechanical seals, on the other hand, have highly polished faces which spin against each other under pressure. Such mechanical seals require precise, and therefore expensive, machining and polishing for proper operation and are also subject to wear and leakage. The complicated and intricate seal structures conventionally used for horizontal mixers are therefore expensive, not only to manufacture, but also to maintain and replace.

Secondly, the stub end seal structure is particularly prone to failure and leakage because of its position in the mixer. Therefore, the stub end seal and bearing structures must be maintained and replaced more frequently than the drive end seal structures. More specifically, the stub end of the shaft not only rotates during use, but also translates linearly in a longitudinal direction along the longitudinal, horizontal axis of the shaft. Since the drive end of the shaft is somewhat fixed due to the drive motor and other associated components, the longitudinal translation of the shaft caused by expansion and contraction of the shaft occurs primarily at the stub end. The shaft expands and contracts in length due to temperature changes during the mixing process. Constant exposure of the shaft to the variations in temperature caused by the heating and cooling of the mixing chamber and the heat generated by the mixing process causes some expansion and linear translation. Furthermore, the shaft itself may be actually heated or cooled such as by introducing steam, water or oil into a cavity in the shaft. Still further, the end walls or end plates of the mixing chamber will also move in and out longitudinally with respect to the shaft due to the temperature variations of the mixing chamber itself. Therefore, the seal structure and the packing elements at the stub end of the mixing shaft are exposed not only to rotational wear but also to significant translational wear, thereby making the stub end seal structure particularly prone to failure and leakage where the stub end of the shaft extends through the end of the mixer.

Leakage at the stub end sealing structure is a particular problem, because once the seal fails, material passes directly into or out of the chamber. There is generally no additional structure adjacent the failed stub end seal structure to further prevent leakage. The bearing supporting the shaft is often spaced away from the stub end sealing structure and away from the end of the mixing chamber and thus does not provide any significant sealing properties. Furthermore, the existence of the separate bearing may prevent additional sealing structures from being utilized at the shaft stub end. As a result, the operation and the integrity of the stub end sealing structure is a predominant concern when using horizontal mixers.

The frequent maintenance required for conventional stub end seals further increases the cost of the mixing process. As mentioned above, existing stub end seal structures used with horizontal mixers are prone to leakage, and thus, require maintenance in the form of replacing the worn packing elements or other mechanical sealing elements to prevent leaks. During such maintenance, whether scheduled or unscheduled, the mixer cannot operate, thus reducing the efficiency of the mixing process and reducing the overall cost-effectiveness of the mixer.

Still further, bearing failure from leakage may also be a problem at the shaft stub end. The stub end seal structure generally acts in concert with an external bearing. The bearings used with conventional horizontal mixers are intricately designed and have balls, rollers or other moving components which are lubricated with free lubricants, such as grease or lubricating oil. When the stub end seal structure leaks, the mixed material may migrate to the bearing and be trapped in the various cavities containing the balls, rollers and other components. This contaminates the lubricants. As a result, the bearing may wear prematurely and be damaged, or the bearing may even lock up and hinder the rotation of the shaft. Additionally, the mixed material may be chemically reactive and may corrode the bearing. Bearing maintenance and replacement due to leakage further increases the cost of operating a horizontal mixture.

Shaft deflection is also a concern associated with currently available horizontal mixers. The rotating shafts of horizontal mixers are designed to handle a certain amount of stress and to only deflect a predetermined amount due to the sag in the shaft between its supported ends. With stress and deflection as a limiting criteria, the shafts are designed and sized in diameter to achieve the acceptable deflection. For example, a deflection of 1/16 of an inch may be acceptable in one mixer design, and thus the diameter of the shaft is sized accordingly. As will be appreciated, conventional horizontal mixers which support the shaft ends (and particularly the stub end) at conventional spaced apart bearings will require relatively large diameter shafts, increasing the costs of the mixer. A larger diameter shaft also requires larger bearing and sealing components, thus further increasing the costs of the mixer. Accordingly, it is desirable to support the stub end of the shaft close to the end wall of the mixing chamber to reduce shaft length and its deflection. It is also desirable to interface a stub end seal structure with a thinner shaft.

Therefore, there is a need for an improved structure for both sealing and providing rotational support of the mixing shaft of a mixer. There is particularly a need for an improved structure for sealing, supporting and rotating the shaft stub end in a horizontal mixer.

It is an objective of the present invention to address the drawbacks of the prior art and to provide a mixer which is less expensive to fabricate and operate than currently available mixers.

It is another objective to prevent leakage of mixed materials from the mixing chamber to the atmosphere and to prevent the leakage of outside contaminants into the mixing chamber to thereby effect better product containment and process environment integrity.

It is another objective of the present invention to seal the stub end of the mixing shaft of a horizontal mixer, while still maintaining the desired rotational integrity of the shaft.

It is another objective of the invention to reduce the effect of lateral and rotational wear on the stub end sealing structure to reduce the seal failure associated with such wear and reduce the required maintenance for the sealing structure.

It is still another objective to reduce the cost and complexity of the sealing and bearing arrangement in a horizontal mixer at the stub end of the mixing shaft.

It is still another objective of the invention to utilize a small diameter shaft to decrease the cost of the mixer.

SUMMARY OF THE INVENTION

The present invention addresses these and other objectives and provides a mixer for mixing and processing materials which comprises a mixing chamber with an inner space for receiving material to be mixed. An elongated rotatable mixing shaft extends through the chamber inner space and has a stub end and a drive end positioned proximate opposing ends of the mixing chamber. In accordance with one aspect of the present invention, a non-rotatable stub shaft extends through an opening in the stub end of the mixing chamber. Particularly, the stub shaft extends through an opening in the stub end head wall. The non-rotatable stub shaft is coupled to the stub end head wall for linear translation therethrough, but the stub shaft is generally prevented from rotating in the end of the mixing chamber. Accordingly, a need for a dynamic seal at the stub end wall is eliminated by the invention. For rotation of the mixing shaft, the stub end of the mixing shaft is rotatably coupled to the non-rotatable stub shaft inside the mixing chamber. Therefore, the stub end of the mixing shaft is contained completely within the mixing chamber, and there is no rotational engagement of the mixing shaft with the stub end head wall.

For sealing the stub end head wall, a seal structure is coupled between the stub shaft and the end of the mixing chamber for sealing the chamber inner space from the environment outside of the mixing chamber. More particularly, in one embodiment, the seal is coupled to a head plate which is then coupled to the head wall of the mixing chamber. The seal structure is operable for moving with linear translation of the stub shaft for maintaining the seal during such translation. The seal structure thus may be a suitable static seal, such as a bellows seal, because the stub shaft does not rotate. A translation bearing is coupled to the stub shaft at the stub end of the chamber on the outside of the head plate and supports the stub shaft during translation. The bearing structure may also generally prevent rotation of the stub shaft. Alternatively, a separate structure might be utilized to prevent rotation of the stub shaft.

For smooth rotation of the mixing shaft, bearing structures are operably coupled between the mixing shaft and the stub shaft. To that end, a journal recess is formed in the stub end of the mixing shaft and a portion of the stub shaft is journaled within the journal recess with the bearing structures operably coupled between the mixing shaft and the stub shaft. A passage may be formed to extend through the stub shaft and couple to the bearing structures for delivering lubricant to the bearing structures.

A cap is coupled to the stub end of the mixing shaft to close the journal recess. The journal portion of the stub shaft extends through the cap for rotatably coupling with the mixing shaft. A dynamic seal is coupled between the cap and the stub shaft at the interface therebetween and is operable for sealing the interface during rotation of the mixing shaft. The dynamic seal may be an appropriate rotational dynamic seal such as a precision mechanical seal, or a lip seal.

The present invention provides a static, non-rotational seal at the stub end wall of the mixing chamber, such that the mixing chamber completely contains the stub end of the rotating mixing shaft. The present invention therefore provides better product containment and process environment integrity. The advantages of the invention are further illustrated by the Detailed Description of the invention set forth hereinbelow.

BRIEF DESCRIPTION OF THE DRAWINGS

The accompanying drawings, which are incorporated in and constitute a part of this specification, illustrate embodiments of the invention, and together with a general description of the invention given above, and the detailed description of the embodiments given below, serve to explain the principles of the invention.

DETAILED DESCRIPTION OF SPECIFIC EMBODIMENTS

Figure 1:
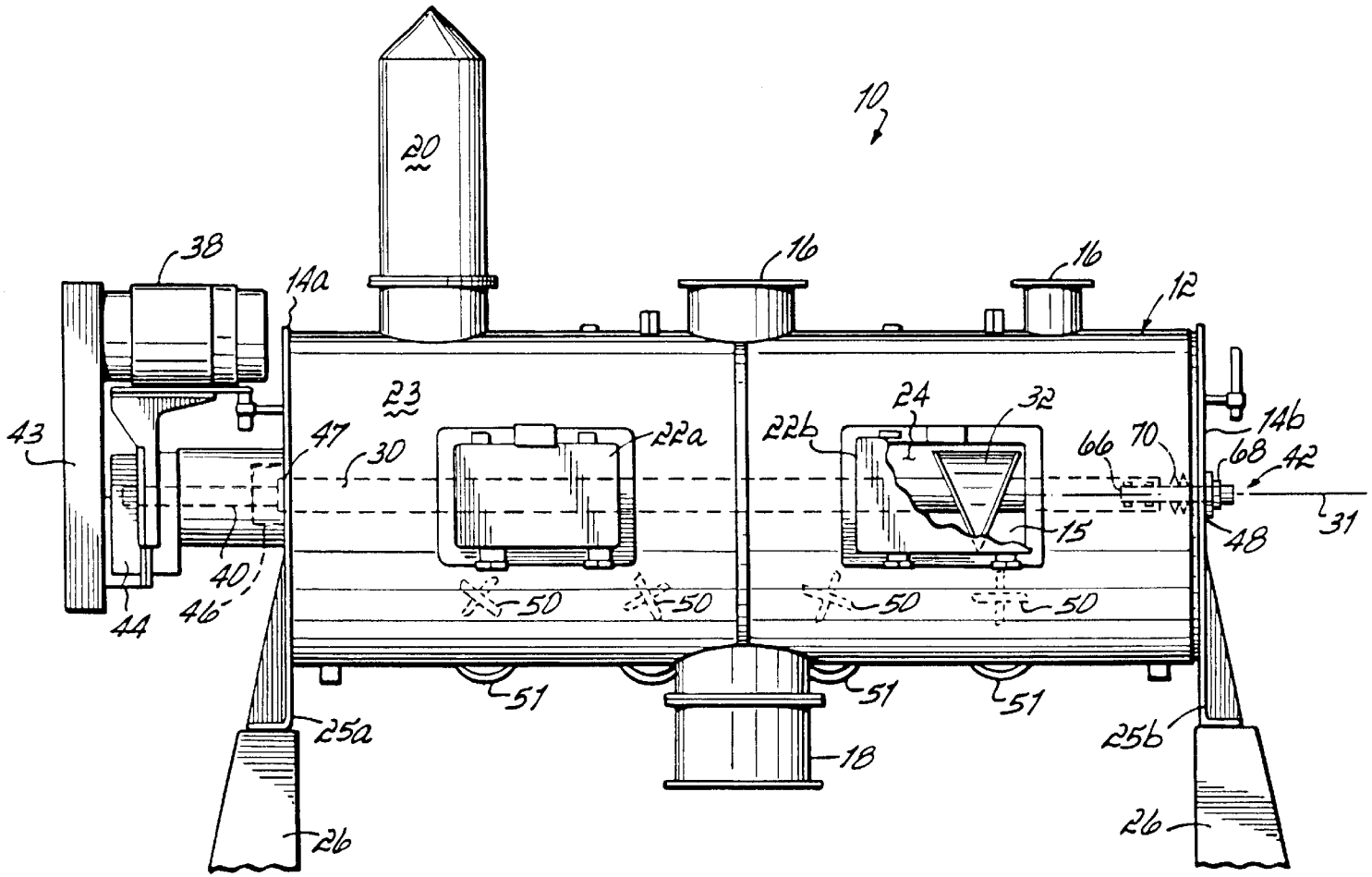
FIG. 1 is a front view of one embodiment of a horizontal mixer which is made in accordance with the principles of the present invention.

FIG. 1 illustrates a horizontal mixer 10 constructed in accordance with the principles of the present invention. The invention may be used with various different types and embodiments of a horizontal mixer, and the mixer 10 illustrates only one such embodiment. The embodiment of the mixer 10 illustrated in FIG. 1 comprises a generally cylindrical and elongated mixing chamber 12 which is horizontally disposed and is configured to receive therein materials which are to be mixed, such as food materials, pharmaceutical materials or plastic materials, for example. The mixing chamber 12 has a generally cylindrically-shaped side wall and opposing end walls or head walls 14*a,* 14*b* which close the ends of the chamber to contain the mixed material.

The chamber defines an inner mixing space 15 for mixing the material.

Although a cylindrically-shaped chamber is illustrated, other horizontal mixer shapes, such a trough-shaped mixers commonly referred to as ribbon mixers or double-arm mixers might also be utilized in accordance with the principles of the invention. Other shapes of horizontal mixers might also be utilized.

Mixer 10 includes one or more charge ports 16 and one or more discharge ports 18 utilized for charging the chamber with materials to be mixed and discharging the mixed material from chamber 12 after it has been properly mixed. The mixer 10 of the invention may also include a ventilation port 20 or other appropriate structure for ventilating any fumes or vapors generated during the mixing process and also for facilitating charge and discharge of product. Furthermore, other apparatuses, such as heaters (not shown), may also be utilized with mixer 10 in order to dry or heat the material being mixed. Cooling systems might also be utilized with mixer 10 to cool material therein. Access to the inside of chamber 12 is provided by access doors 22*a,* 22*b* which are hingedly coupled to the outside surface 23 of the side wall of the chamber 12.

The inside surface 24 of the side wall which defines inner space 15 is preferably polished so that the mixed material slides easily thereover for mixing and discharging as required. Chamber 12 is generally a large capacity mixer in the range of approximately 300–30,000 liters and therefore, the components of the mixer are expected to handle substantial mixing loads. The end walls 14*a,* 14*b* include respective leg extension portions 25*a,* 25*b* which are mounted on an appropriate support structure 26 for elevating the mixing chamber 12 and particularly the discharge port 18 above a ground surface. Alternatively, mixer 10 might be mounted directly on the ground as long as sufficient clearance of discharge port 18 is provided.

For mixing within space 15 of chamber 12, the horizontal mixer 10 of the invention further comprises an elongated mixing shaft 30, having a longitudinal axis 31 which is horizontally disposed so that the shaft is preferably coaxially mounted with the cylindrically-shaped chamber 12. Mixing shaft 30 is usually somewhat heavily constructed for handling the large load mixing of horizontal mixer 10. One suitable shaft is fabricated of 316 stainless steel, and may have an outer diameter in the mixing chamber in the range of approximately 2¼ inches to 16 inches. The length of the shaft 30 will vary with the capacity of the mixer 10.

A plurality of mixing tools, such as mixing plows 32, are coupled to the shaft 30 by support arms which are appropriately fixed or bolted to shaft 30. Preferably, the mixing tools 32 are staggered both longitudinally on shaft 30 and also radially around shaft 30 as appropriate to provide proper mixing. The support arms and the mixing tools 32 are configured so that the heads or plows of the mixing tools sweep freely past the polished inside surface 24 of the chamber 12. The spacing of the tools 32 from the inside surface 24 is varied depending upon the mixing process. In that way, the mixing tools can engage, move, and therefore mix the material in the chamber without leaving any residual material unmixed against the inside surface 24 of the side wall. Therefore, proper spacing between the mixing tools 32 and surface 24 is desirable.

As may be appreciated, the length of shaft 30 will inherently create a certain amount of deflection in the shaft 30 because it is supported only at its ends. The amount of deflection and stress on shaft 30 will then determine what kind of shaft diameter is necessary for the desired deflection and proper spacing of the mixing tools during mixing. As may be appreciated, the farther the distance between the points of support at the ends of the shaft, the greater the amount of deflection and stress and thus the larger the shaft diameter required. Currently available horizontal mixers utilize heavily-designed, large diameter shafts to obtain the required deflection. However, such shafts are more expensive to fabricate and are also more difficult to seal given the larger diameter and the greater surface area that must be sealed. The present invention reduces the effective diameter of the shaft necessary to achieve a desired deflection as discussed below while providing improved sealing at the shaft ends.

Referring to FIG. 1, shaft 30 of the invention includes a driven end or drive end 40 and a non-driven end or stub end 42 opposite the drive end 40. A drive motor 38 is operably coupled to a belt drive 43 which, in turn, is operably coupled to the shaft drive end 40 by an appropriate gear box and bearing structure 44. The gear box and bearing structure 44 will generally reduce the drive ratio between the drive motor 42 and shaft 30. An elaborate dynamic seal structure 46 is coupled to drive end 40 between the gear box and bearing structure 44 and the respective chamber end wall 14a. The shaft drive end 40 protrudes through an appropriate opening 47 in end wall or head wall 14*a*. As discussed further hereinbelow, however, the rotating stub end of the shaft does not extend through the other head wall 14*b* of the chamber 12.

The dynamic seal structure 46 seals opening 47 to prevent the migration of mixed material out of chamber 12 and into the atmosphere along the shaft 30 and through the opening 47. Seal structure 46 may comprise a series of adjacent braided packing elements (not shown) and also may include an air line (not shown) for preventing leakage as discussed above. Furthermore, seal structure 46 preferably prevents any entry of foreign matter into the mixing chamber 12 through opening 47. Seal structure 46 is an appropriate dynamic seal for sealing the shaft drive end 40 and the opening 47 while allowing rotation of the shaft 30. To that end, seal structure 46 might also utilize appropriate air or fluid lines (not shown) to maintain a vacuum or pressurized environment within chamber 12 as necessary for properly mixing and containing the material in chamber 12. The stub end of shaft 30 is more susceptible to leakage than the drive end. The present invention improves upon the stub end design of a horizontal mixer to maintain the integrity of the mixing process.

As illustrated in FIG. 1, drive motor 38 is indirectly coupled to shaft drive end 40 by belt drive 43 and is positioned above the shaft drive end 40. However, for larger mixer applications and for a higher power drive motor, the drive motor 38 might be directly coupled to shaft 30 by an appropriate gear and coupling structure, bearing structure, and a separate seal structure.

Mixer 10 might also be utilized for granulating material as it is mixed. To that end, mixer 10 might include chopper blades 50 coupled to appropriate motors 51 for grinding, chopping and granulating the material during the mixing process.

Figure 2:
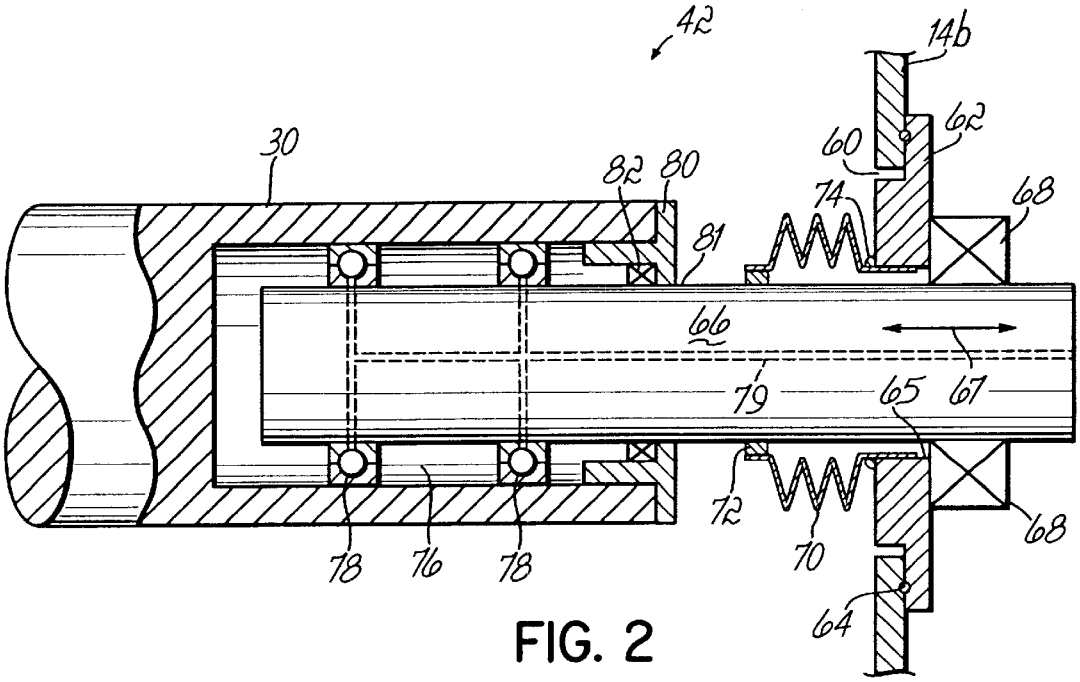
FIG. 2 is a cross-sectional view illustrating a mixing shaft stub end in accordance with one embodiment.

Referring now to FIG. 2, the invention simultaneously seals and rotatably supports the stub end of the mixing shaft to prevent leakage and migration of the mixed material out of the chamber at the stub end and also to prevent the leakage and introduction of foreign material into the chamber through the stub end, and thereby maintain process integrity. The invention eliminates the need for an expensive, elaborate dynamic seal structure to seal the opening in the head wall 14*b*.

FIG. 2 is a cross-sectional view of the stub end of the mixing shaft and its coupling to the respective stub end and head wall of the mixer. Specifically, the stub end head wall 14*b* includes an opening 60 formed therein. A head plate 62 is coupled to head wall 14*b* to seal the opening 60. The head plate 62 is fastened to the end wall by appropriate means, such as by being bolted to the head wall. A seal, such as an O-ring seal 64 is utilized between the head wall 14*b* and the head plate 62 to seal the interface between those components.

In accordance with one aspect of the present invention, the head plate 62 also has an opening 65 formed therein. A non-rotatable stub shaft 66 extends through the opening 65. As discussed further hereinbelow, the stub shaft is generally prevented from rotating, but is free to move linearly or translate along its longitudinal axis, as indicated by reference arrows 67. Therefore, the stub shaft is designated herein as non-rotatable because it does not rotate. The stub shaft 66 is coupled to the head wall 14*b* of the mixing chamber by a translation bearing 68. The translation bearing 68 engages the stub shaft 66 to support the stub shaft and generally prevent rotation of the stub shaft 66 while allowing its linear translation. The translation bearing 68 is coupled to the head plate 62 by an appropriate means, such as bolts or welding. Non-rotation of the stub shaft may be achieved by appropriate pin or key structures or the end of the shaft proximate the head wall may have a particular shape which prevents its rotation within the head wall. The head plate 62 and translation bearing 68 are of sufficient strength to support the stub end of the mixing shaft which is rotatably coupled to the stub shaft 66, as illustrated in FIG. 2. The stub shaft is prevented from rotating either by the translation bearing or by a separate structure (not shown) coupled to the stub shaft proximate the head wall. The structure used to prevent rotation must also allow translation of the stub shaft.

In accordance with the principles of the present invention, the non-rotatable stub shaft provides a significant improvement over existing structures, as the stub shaft may be sealed to the stub end of the mixing chamber using a static, non-rotating seal, rather than a rotational dynamic seal. As such, the static seal provides a better effective product containment and an improved process environment integrity. As noted above, dynamic seals subject to the vigorous rotation and translation of the stub end of the shaft are subject to rapid wear, and therefore require constant maintenance and frequent replacement to prevent leakage. The present invention reduces such maintenance and provides better product containment than prior art structures.

Stub shaft 66, in one embodiment of the invention, is between 12 and 18 inches long, and is formed of stainless steel, such as the stainless steel similar to that used to form the mixing shaft.

To provide a non-rotational static seal for the stub shaft at the stub end head wall 14*b* of the mixer, a seal structure 70 is coupled between the stub shaft 66 and the head plate 62 at the end of the mixing chamber. The seal structure 70 seals the opening in the head plate and thereby seals the chamber inner space from the environment outside of the mixing chamber. Furthermore, the static seal structure, although non-rotational, is operable for translating or moving linearly, with the linear translation of the stub shaft. In that way, seal structure 70 maintains the seal of the stub shaft in head plate 62 during such translation. In one embodiment of the invention, the seal structure 70 is a bellows seal which is capable of expanding in length as the stub shaft 66 translates. The seal structure 70 is coupled at one end to the stub shaft by an appropriate means, such as seal rings 72. The seal structure 70 is fixed at the other end to the head plate 62 at the end of the mixer by an appropriate means, such as a weld 74. The static seal structure 70 provides better product containment and improved process environment integrity at the stub end of the mixer because it is not subject to significant wear due to rotation. While the stub shaft will translate, due to the heating and cooling of the shaft, seal structure 70 is able to adequately handle such translation, which will generally be gradual and not as physically demanding as rapid rotation. The seal structure also will be able to withstand the process conditions in the chamber, including the pressure or vacuum therein. The bellows forming one embodiment of the seal structure may be made of a suitable metal, such as stainless steel, or may also be an elastomer.

For providing rotation of the mixing shaft, the stub end 42 of the mixing shaft 30 is rotatably coupled to the stub shaft 66 within the inner space and inside the stub end head wall 1 4b and head plate 62. That is, the stub end 42 of the shaft is contained entirely within the mixing chamber, and does not extend through the end of the mixing chamber. Referring to FIG. 2, stub end 42 of the mixing shaft includes a journal recess 76 which is formed or machined therein. A portion of the stub shaft 66 is journaled in the journal recess 76 for rotatably coupling the mixing shaft to the stub shaft. One or more bearing structures 78 are operably coupled between the mixing shaft 30 and the journaled portion of the stub shaft for rotatably coupling the mixing shaft to the stub shaft. As illustrated in FIG. 2, the bearing structures 78 surrounds the stub shaft, and the wall of the journal recess 76 surrounds the bearing structures. The bearing structures are of suitable construction to allow free rotation of the mixing shaft 30 about the stub shaft 66. Suitable bearing structures, such as ball bearing structures are commercially available for interfacing between the stub shaft and the stub end of the mixing shaft, as illustrated. Stub shaft 66 has a length in the range of 12–18 inches in one embodiment. To provide lubrication to the bearing structures 78, an appropriate passage 79, may be formed or machined in the stub shaft, and may be coupled to an appropriate supply of lubricant (not shown). Passage 79 is coupled to the bearing structures 78 for delivering lubricant to those bearing structures. The non-rotational nature of the stub shaft 66 assures that lubricant may be delivered to the bearing structures through the stub shaft 66 without the need for rotational seals or rotational coupling to the bearing structure.

To prevent product from entering into the journal recess 76 and into the bearings 78, and to prevent lubricant from entering the mixing chamber, the invention further comprises a cap 80 which is coupled to the stub end of the mixing shaft to effectively close and seal the journal recess 76. An appropriate opening 81 is formed in the cap so that the journaled portion of the stub shaft 66 may extend through the cap for rotatably coupling with the bearing structures 78. Cap 80 may be appropriately sealed onto the end of the mixing shaft, such as by welding, or bolts with an appropriate O-ring seal (not shown).

To seal the opening 81 through which the stub shaft 66 extends, a dynamic seal 82 is utilized which is operable during rotation to seal the end of the mixing shaft. The dynamic seal might be a lip seal, or might be a precisely machined mechanical seal which is able to withstand the rotation of mixing shaft 30 about the stub shaft 66. The dynamic seal, because of the rigidity of the short stub shaft and its close proximity to the bearings, will not have to withstand a significant amount of radial deflection of the stub shaft. Therefore, the life and performance of the dynamic seal is enhanced.

Accordingly, the present invention provides a significant improvement in the sealing and support of the stub end of the mixing shaft in a horizontal mixer. With the elimination of a rotational shaft extending through the stub end of the mixer, there is no need for a dynamic seal, and the resulting maintenance and replacement of the dynamic seal at the stub end wall. As such, better prevention of leakage into or out of the mixing chamber is provided to effect better product containment and process environment integrity. The cost of fabricating the mixer is reduced, as is the cost of maintaining the mixer during its operation.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A mixer for mixing and processing materials comprising:

a mixing chamber having a wall defining an inner space configured for receiving material to be mixed;

an elongated rotatable mixing shaft extending through the chamber inner space, the shaft having a stub end and a drive end positioned proximate opposing ends of the mixing chamber;

a non-rotatable stub shaft extending through an opening in the end of the mixing chamber and coupled to the chamber end for linear translation therethrough, the stub shaft being generally prevented from rotating in the chamber end;

the stub end of the mixing shaft rotatably coupled to the stub shaft within the inner space for rotating in the mixing chamber without extending through the end of the chamber;

a seal structure coupled between the stub shaft and the end of the mixing chamber for sealing the chamber inner space from the environment outside of the mixing chamber, the seal structure operable for moving with the linear translation of the stub shaft for maintaining the seal during such translation;

whereby better product containment and process environment integrity is achieved in the mixing chamber.

2. The mixer of claim 1 comprising a translation bearing coupled to the stub shaft at the chamber end for supporting the stub during rotation.

3. The mixer of claim 1 wherein said seal structure includes an expandable bellows seal.

4. The mixer of claim 1 further comprising a bearing structure operably coupled between the mixing shaft and the stub end shaft for rotatably coupling the mixing shaft to the stub shaft.

5. The mixer of claim 4 further comprising a passage extending through the stub shaft, the passage coupled to the bearing structure for delivering lubricant to the bearing structure.

6. The mixer of claim 1 further comprising a journal recess formed in the stub end of the mixing shaft, a portion of the stub shaft being journaled in the journal recess for rotatably coupling the mixing shaft to the stub shaft.

7. The mixer of claim 6 further comprising a bearing structure positioned in the journal recess and operably coupled between the mixing shaft and the stub end shaft for rotatably coupling the mixing shaft to the stub shaft.

8. The mixer of claim 6 further comprising a cap coupled to the stub end of the mixing shaft to close the journal recess, the journaled portion of the stub shaft extending through the cap for rotatably coupling the mixing shaft to the stub shaft.

9. The mixer of claim 8 further comprising a dynamic seal coupled between the cap and the stub shaft at an interface therebetween, the dynamic seal operable for sealing the interface during rotation of the mixing shaft.

10. A method for supporting the stub end of a mixing shaft in a horizontal mixer comprising:

positioning an elongated rotatable mixing shaft to extend through a mixing chamber of a horizontal mixer, wherein the shaft has a stub end and a drive end positioned proximate opposing ends of the mixing chamber;

extending a non-rotatable stub shaft through an opening in the end of the mixing chamber;

coupling the stub shaft to the chamber end for linear translation therethrough and generally preventing the stub shaft from rotating in the chamber end;

rotatably coupling the stub end of the mixing shaft to the stub shaft inside the chamber for rotating in the mixing chamber without extending through the end of the chamber;

coupling a seal structure between the stub shaft and the end of the mixing chamber for sealing the inside of the mixing chamber from the environment outside of the chamber, the seal structure operable for moving with the linear translation of the stub shaft for maintaining the seal during such translation;

whereby better product containment and process environment integrity is achieved in the mixing chamber.

11. The method of claim 10 further comprising coupling a translation bearing to the stub shaft at the chamber end for supporting the stub during rotation.

12. The method of claim 10 wherein said seal structure includes an expandable bellows seal.

13. The method of claim 10 further comprising operably coupling a bearing structure between the mixing shaft and the stub end shaft for rotatably coupling the mixing shaft to the stub shaft.

14. The method of claim 10 further comprising forming a journal recess in the stub end of the mixing shaft, and positioning a portion of the stub shaft in the journal recess for rotatably coupling the mixing shaft to the stub shaft.

15. The method of claim 14 further comprising positioning a bearing structure in the journal recess between the mixing shaft and the stub end shaft for rotatably coupling the mixing shaft to the stub shaft.

16. The method of claim 14 further comprising coupling a cap to the stub end of the mixing shaft to close the journal recess, and extending the portion of the stub shaft through the cap for rotatably coupling the mixing shaft to the stub shaft.

17. The method of claim 16 further comprising coupling a dynamic seal between the cap and the stub shaft at an interface therebetween for sealing the interface during rotation of the mixing shaft.

* * * * *